US007225940B2

(12) United States Patent
Almeida

(10) Patent No.: US 7,225,940 B2
(45) Date of Patent: Jun. 5, 2007

(54) OIL SHIELD DISPENSER

(76) Inventor: Jorge R. Almeida, 342 Hathaway Blvd., Unit 11, New Bedford, MA (US) 02740

( * ) Notice: Subject to any disclaimer, the term of this patent is extended or adjusted under 35 U.S.C. 154(b) by 633 days.

(21) Appl. No.: 10/677,509

(22) Filed: Oct. 3, 2003

(65) Prior Publication Data

US 2005/0072079 A1 Apr. 7, 2005

(51) Int. Cl.
*H02G 3/08* (2006.01)
*F16L 5/00* (2006.01)

(52) U.S. Cl. ..... 220/3.3; 220/476; 137/360; 52/302.1

(58) Field of Classification Search ..... 52/202, 52/302.1, 302.3, 302.5, 302.6, 302.7; 220/476–477, 220/480, 3.3, 3.2, 3.5, 3.9; 137/343, 360, 137/361; 312/229, 228, 242, 245–246
See application file for complete search history.

(56) References Cited

U.S. PATENT DOCUMENTS 2,703,911 A * 3/1955 Griffin ..... 52/302.3
2,779,065 A * 1/1957 Rehme ..... 52/302.1
3,847,175 A * 11/1974 Anderson ..... 137/360
4,564,249 A * 1/1986 Logsdon ..... 312/229
4,890,396 A * 1/1990 King ..... 34/235
5,138,595 A * 8/1992 Wachi ..... 369/44.35
5,191,171 A * 3/1993 Bordwell ..... 174/666
5,476,183 A * 12/1995 Harpenau ..... 220/3.3
5,484,522 A * 1/1996 Entrekin ..... 210/86
6,125,881 A * 10/2000 Hobbs et al. ..... 137/360
6,129,109 A * 10/2000 Humber ..... 137/360
6,155,286 A * 12/2000 Geary ..... 137/360
2005/0133134 A1* 6/2005 Ingram et al. ..... 152/417

* cited by examiner

*Primary Examiner*—Jeanette Chapman
(74) *Attorney, Agent, or Firm*—Jeffrey K. Seto

(57) ABSTRACT

A device for protecting the surface of homes and surrounding soil from heating oil spillage during the filling process of a heating oil tank that is stored inside of or underneath the home. The device catches any spilled oil thereby protecting the home and preventing contamination of the surrounding soil. Traditional heating oil tanks must be refilled on a regular basis, usually via a fill tube that extends from the tank through an exterior wall of the home. Some spillage usually occurs during each filling procedure, causing cosmetic and environmental problems. The present device solves this problem by providing a device that protects the home and surrounding soil by catching any oils that spills during filling. It does so by providing an aluminum device, in the preferred embodiment, that covers the fill neck and vent line, and provides a basin in which the spilt oil can be caught. By providing a structure that can protect the home and surrounding environment from the problem of oil spillage, this device allows for a more convenient and pleasant use of oil-fired heating systems.

9 Claims, 5 Drawing Sheets

OIL SHIELD DISPENSER

BACKGROUND OF THE INVENTION

The present invention relates generally to protection devices and more specifically to a device for protecting exterior walls and soil from heating oil spills.

Heating oil is used in many homes for the warmth and comfort it provides. Heat that is produced by heating oil is often less expensive than electric heat, and is not affected by power outages or electrical malfunctions. Oil heating systems are often frequently in need of less repair or replacement than other heating systems. One of the downsides, however, of oil heating systems is the need to have the oil replenished throughout the year, the side effects of which are not always pleasant or convenient.

Many homes use oil-fired heating systems, with oil storage tanks stored inside of or beneath the home. The units are either stored in the basement or in the ground underneath of the home. In order to fill the oil storage containers, there is typically a device for this purpose attached to the outside of the home. This device typically has two components, a vent line and a filler neck. When oil companies come to the home to refill the oil storage container via the filler neck, spills or splashes frequently occur, discoloring the area of the wall itself, as well as contaminating the surrounding soil.

The present invention solves this common problem by providing a protective unit for the oil-filling device. The device essentially consists of a catch pan or guard surrounding the filler neck and vent line of an underground heating fuel storage tank. The device is compact and reliable, as there are not moving parts. The present device provides an improved level of cleanliness and can be used with most oil filling systems. By solving the problem of overall cleanliness, the present embodiment provides users of oil heating systems with a higher level of satisfaction and convenience with their systems.

SUMMARY OF THE INVENTION

A device for protecting an exterior wall of a building and a ground area adjacent to the exterior wall from spillage of heating oil during and after filling of a heating oil tank that is located within the building. The heating oil tank includes a fill tube that extends from the oil tank through the exterior wall. The device comprises a panel that is adapted to attach to the exterior wall, a basin that is adapted to catch any heating oil that spills out of the fill tube, and a means for attaching the panel to the exterior wall. The panel includes a first hole that is adapted to allow the fill tube to extend through the first hole. The basin is attached to a lower portion of the panel.

The panel may further include a second hole that is adapted to allow a vent tube to extend through the second hole. The panel and the basin are preferably made of a metallic material. The preferred means for attaching the panel to the exterior wall include one or more screws. The panel is preferably 20 inches wide and 36 inches in height. The basin preferably has a holding capacity of 24 ounces to 1 gallon. In the preferred embodiment, the top portion of the basin is completely open and the open top portion is wider than a lower portion of the basin.

It is an object of the present invention to protect homes and surrounding soil from spillage during the filling of heating oil tanks.

BRIEF DESCRIPTION OF THE DRAWINGS

The invention of the present application will now be described in more detail with reference to the accompanying drawings, given only by way of example, in which.

DETAILED DESCRIPTION OF THE INVENTION

Figure 1:
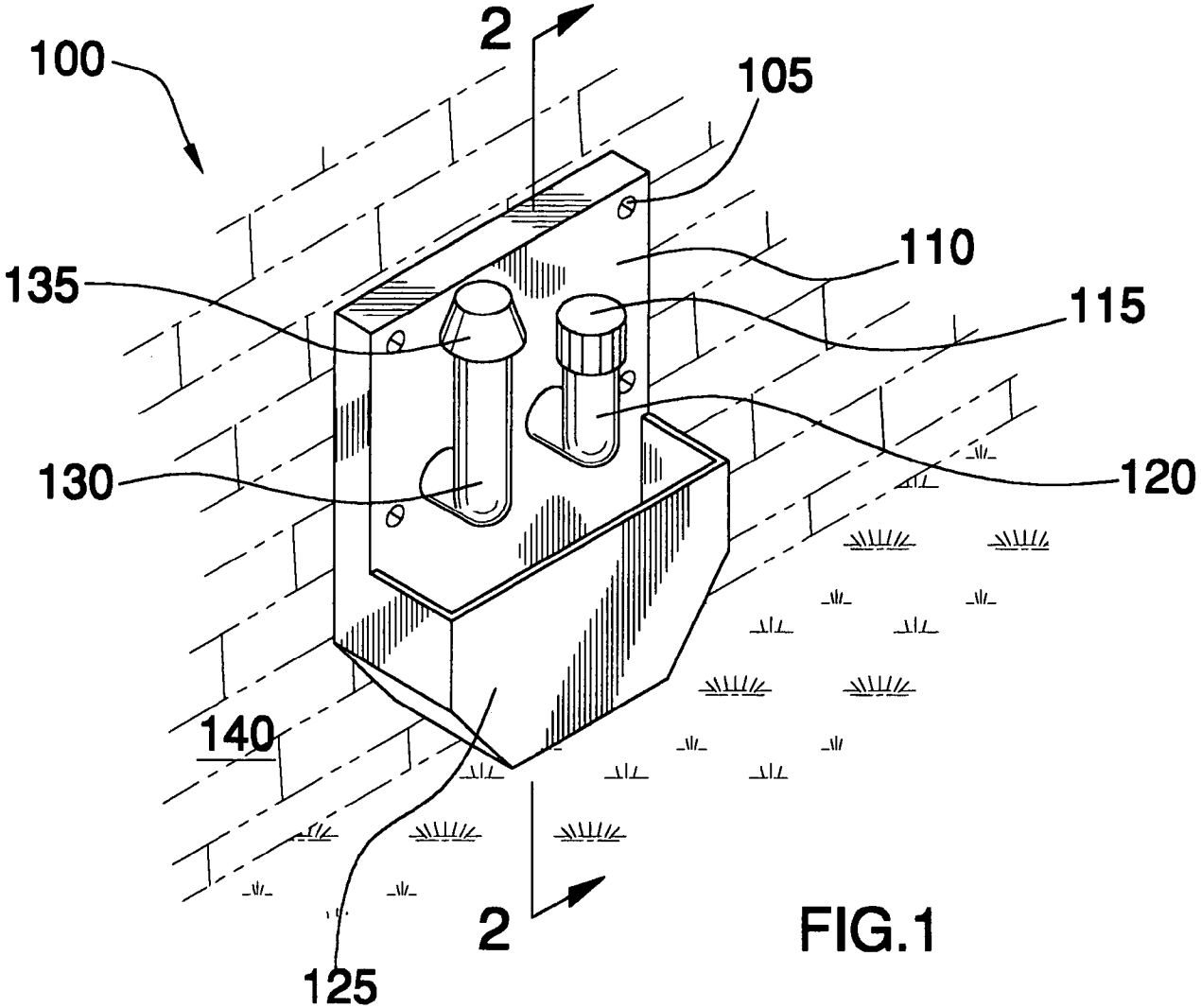
FIG. 1 shows the preferred embodiment attached to the outside of a home.

FIG. 1 shows the preferred embodiment 100 of the present protective device in its operational position. In this position, the device protects the outside of a home and the surrounding soil from heating oil spills. The heating oil is stored in a tank (not shown) that is either inside or beneath the home. The heating oil tank includes a vent tube 130 and a fill tube 120 that extend from the tank through an exterior wall 140 of the home. The fill tube 120 allows the heating oil tank to be filled from an exterior portion of the home. The vent tube 130 allows exhaust from the heating system to escape harmlessly into the environment. The fill tube 120 includes a cap 115 that must be removed prior to filling. The vent tube 130 includes a hood 135 that prevent rain and other objects from falling into the tube. The present device 100 consists of a protective panel 110 and a basin 125 that is attached to the lower portion of the protective panel 110. The panel 110 is attached to exterior wall 140 by screws 105. The screws 105 can be masonry screws for attaching the panel 110 to brick walls, or other types of screws, such as wood screws, suitable for attaching the panel to exterior walls made of materials other than brick. The panel 110 includes two holes that allow the fill tube 120 and the vent tube 130 to protrude therethrough.

When the heating oil tank is filled, a service person removes cap 115 from fill tube 120 and attaches a supply hose to fill tube 120. The other end of the supply hose is attached to a supply of heating oil, usually carried on the back of a tanker truck. Once the supply hose is attached to the fill tube 120, the service person begins the flow of heating oil from his truck to the fill tube 120, and ultimately to the heating oil tank stored in the home. When the service person is finished pumping the desired amount of heating oil, he shuts off the pump on his truck and removes the supply hose from the fill tube 120. It is at this point that oil spills usually occur, either from overflow caused by too much oil being supplied or from residual oil dripping from the supply hose. The panel 110 protects the home from oil splashing on the exterior wall 140 and the basin 125 catches any oil that would otherwise fall onto the soil beneath the fill tube.

Figure 2:
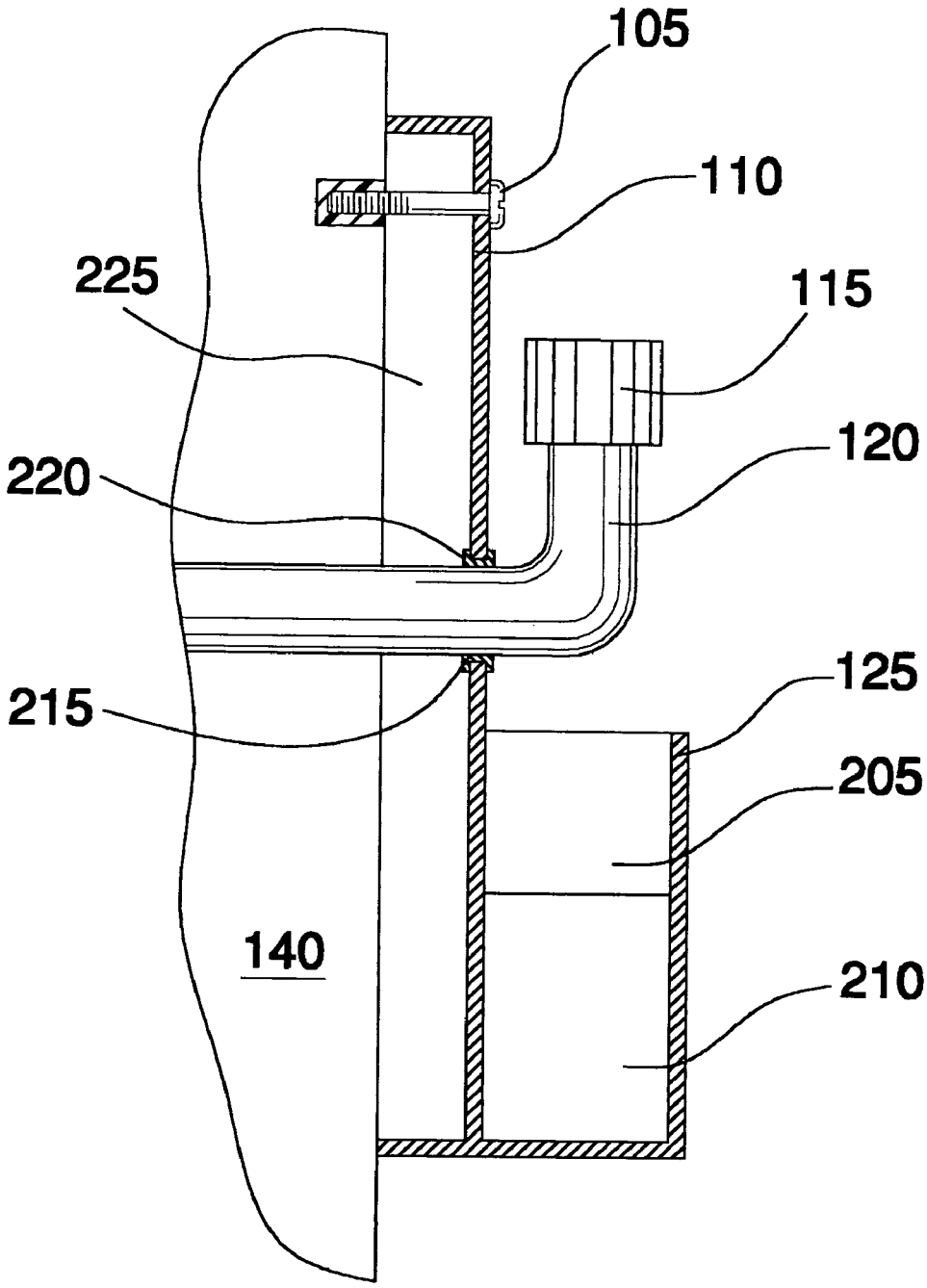
FIG. 2 is a cross-sectional view of the preferred embodiment in its operational position.

The arrows with the number 2 next to them, in FIG. 1, indicate the perspective that is provided in the cross-section view of FIG. 2.

FIG. 2 shows a cross-sectional view of the preferred embodiment of the present protective device. It can be seen that the panel 110 is actually set off from the exterior wall 140 thereby creating a gap 225 between the panel and the wall. The screw 105 that attaches the panel to the wall is sufficiently long so that it passes through the panel 110 and the gap 225, and is able to seat itself into the exterior wall 140. The fill tube 120 extends through wall 140 and a hole in panel 110, and can be held in place within panel 110 by embracing members 215 and 220, which may be the top and bottom portions of a rubber or plastic washer. The basin 125 includes an open top portion 205 and an angled lower portion 210. The basin 125 catches any oil that spills during the filling procedure and allows for easy clean up of the spilled oil.

Figure 3:
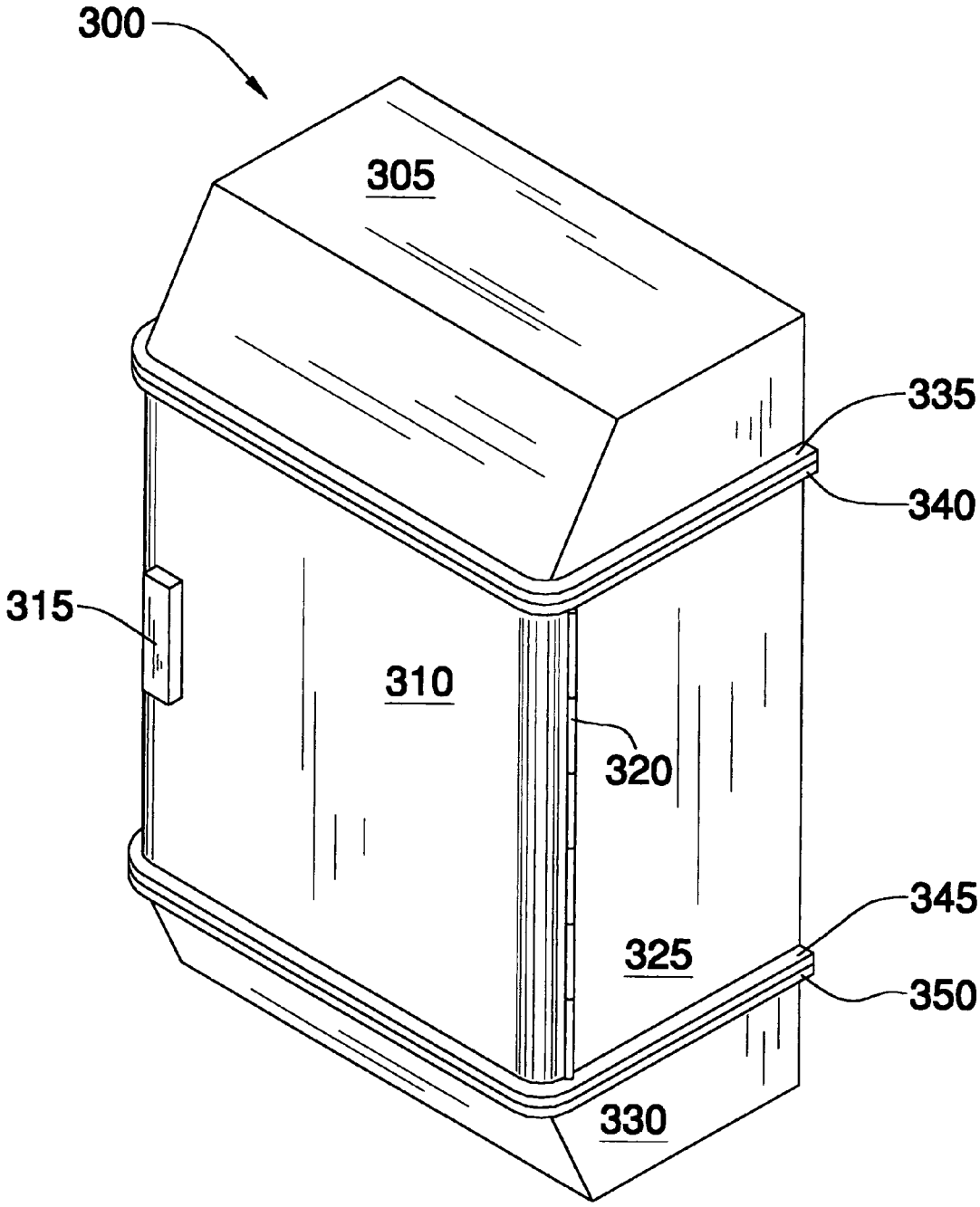
FIG. 3 shows an alternative embodiment.

FIG. 3 shows an alternative embodiment of the present invention. In this embodiment, a complete enclosure 300 is provided for the fill tube and vent tube. The enclosure includes a top 305, sides 325, door 310 and bottom (catch pan) 330. The door includes handle 315 and hinges 320 that are used to open the door 310 and gain access to the fill tube housed within. The enclosure 300 completely covers the fill and vent tubes thereby providing protection from the weather and presenting an aesthetically pleasing appearance. Extended lips 335 and 340 form a weather resistant seal between the top 305 and the upper portions of sides 325 and door 310. Extended lips 345 and 350 form a weather resistant seal between the catch pan 330 and the lower portions of sides 325 and door 310.

Figure 4:
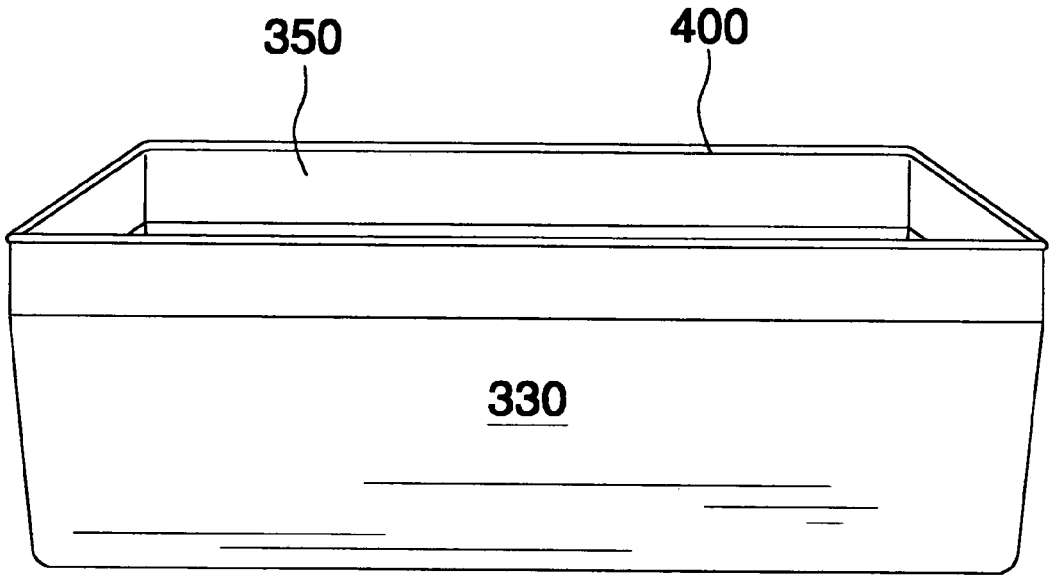
FIG. 4 shows the catch pan of the alternative embodiment.

FIG. 4 is a more detailed picture of catch pan 330. Catch pan 330 prevents any oil that spills during filling from falling on the soil below, thereby preventing unwanted contamination of soil, plants or whatever else is below the fill tube. Preferably, the extended lip 350 includes a rubber gasket 400 that extends all the way around the top of extended lip 350. Rubber gasket 400 aids in providing a weather resistant seal between the catch pan 330 and the lower portions of the door and sides of enclosure 300.

Figure 5:
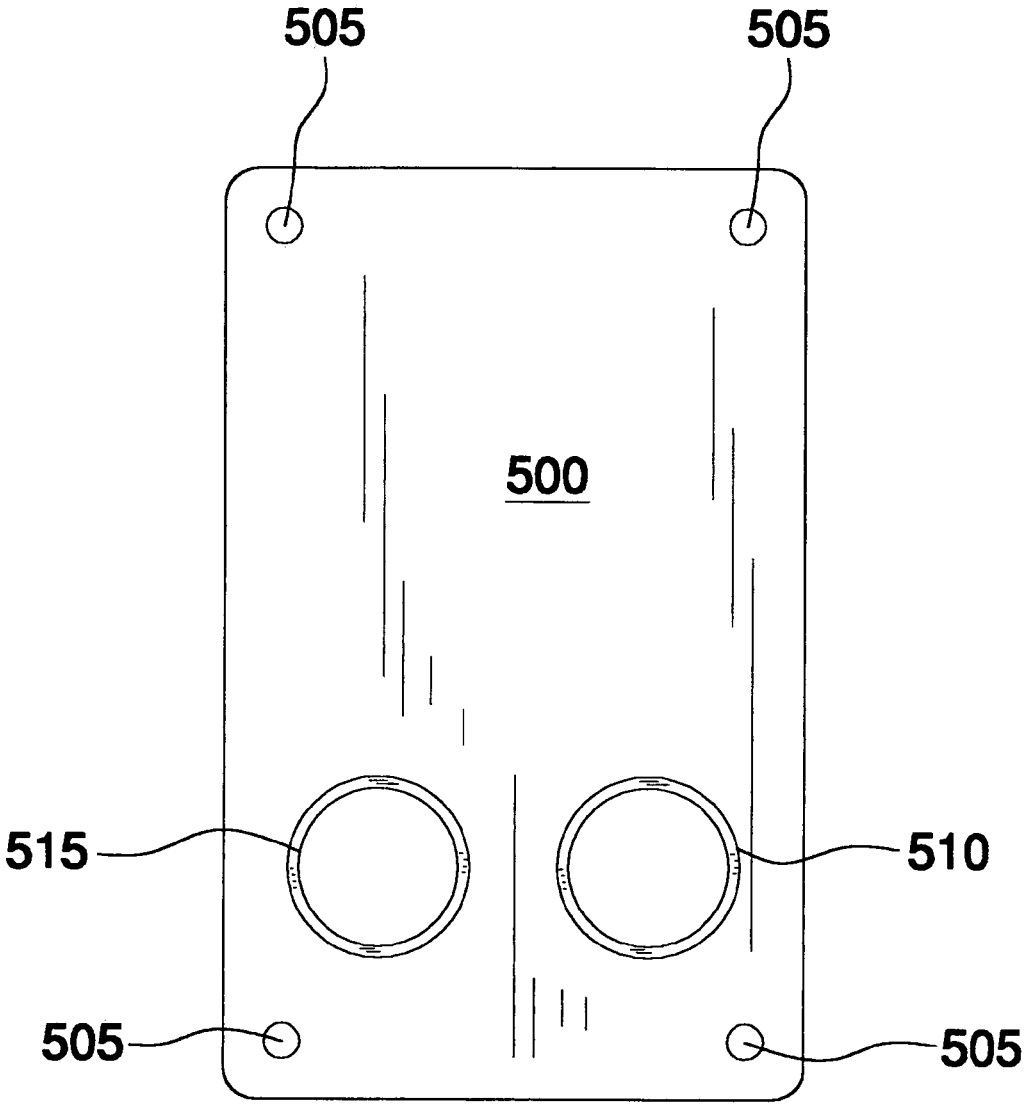
FIG. 5 shows the back wall of the alternative embodiment.

FIG. 5 shows the back panel 500 of enclosure 300. Back panel 500 includes four holes 505 that are used to attach the enclosure to the exterior of a house, or other structure through which the external fill and vent tubes protrude. Openings 510 and 515 allow for passage of the fill and vent tubes through the back panel 500 and into the protected space within the enclosure 300. The preferred dimensions of this embodiment are 36 inches (") from high, 20" wide and 10" from front to back.

The foregoing description of the specific embodiments will so fully reveal the general nature of the invention that others can, by applying current knowledge, readily modify and/or adapt for various applications such specific embodiments without departing from the generic concept. Therefore, such adaptations and modifications should and are intended to be comprehended within the meaning and range of equivalents of the disclosed embodiments. It is to be understood that the phraseology of terminology employed herein is for the purpose of description and not of limitation.

I claim:

1. A device for protecting an exterior wall of a building and a ground area adjacent to the exterior wall from spillage of heating oil during and after filling of a heating oil tank that is located within the building, wherein the heating oil tank includes a fill tube that extends from the oil tank through the exterior wall, the device comprising:

a panel that is adapted to attach to the exterior wall, wherein the panel includes a first hole that is adapted to allow the fill tube to extend through the first hole;

a basin that is adapted to catch any heating oil that spills out of the fill tube wherein, the basin is attached to a lower portion of the panel;

a means for attaching the panel to the exterior wall; and, a housing that completely covers the panel, the basin and the means for attaching, the housing also being adapted to enclose the heating oil fill tube that extends through the first hole in the panel, wherein the housing includes a door that allows a user to gain access to an interior of the housing.

2. The device of claim 1, wherein the panel further includes a second hole that is adapted to allow a vent tube to extend through the second hole.

3. The device of claim 1, wherein the panel and the basin are made of a metallic material.

4. The device of claim 1, wherein the means for attaching the panel to the exterior wall includes one or more screws.

5. The device of claim 1, wherein the panel is 14–20 inches wide and 24–36 inches in height.

6. The device of claim 1, wherein the basin has a holding capacity of 8 ounces to 1 gallon.

7. The device of claim 1, wherein the basin has an open top portion that is wider than a lower portion of the basin.

8. The device of claim 1, wherein the first hole includes a washer for protecting and securing the fill tube.

9. The device of claim 2, wherein the second hole includes a washer for protecting and securing the vent tube.

* * * * *